US010151452B2

(12) United States Patent
Huang et al.

(10) Patent No.: US 10,151,452 B2
(45) Date of Patent: Dec. 11, 2018

(54) VARIABLE FOCUS LIGHTING FIXTURE

(71) Applicant: Chun Kuang Optics Corp., Hsinchu County (TW)

(72) Inventors: Hsin-Chieh Huang, Hsinchu County (TW); Shun Wang, Hsinchu County (TW); Shun-Wen Teng, Hsinchu County (TW)

(73) Assignee: CHUN KUANG OPTICS CORP., Hsinchu County (TW)

( * ) Notice: Subject to any disclaimer, the term of this patent is extended or adjusted under 35 U.S.C. 154(b) by 211 days.

(21) Appl. No.: 15/271,232

(22) Filed: Sep. 21, 2016

(65) Prior Publication Data

US 2018/0080634 A1 Mar. 22, 2018

(51) Int. Cl.

| | |
|---|---|
| ***F21V 14/06*** | (2006.01) |
| *F21Y 115/10* | (2016.01) |
| *F21V 17/02* | (2006.01) |

(52) U.S. Cl.

CPC ..... *F21V 14/06* (2013.01); *F21V 17/02* (2013.01); *F21Y 2115/10* (2016.08)

(58) Field of Classification Search

CPC ..... F21L 15/02; F21S 41/635; F21V 17/02; F21V 14/06; F21V 14/065

See application file for complete search history.

(56) References Cited

U.S. PATENT DOCUMENTS 8,371,710 B2 2/2013 Gupta et al.
2008/0316734 A1* 12/2008 Spartano ..... F21L 14/00 362/105
2010/0290229 A1 11/2010 Meyer, Sr. et al.
2011/0075424 A1 3/2011 Gang et al.
2011/0080736 A1* 4/2011 Brands ..... F21L 4/027 362/277
2012/0147606 A1 6/2012 Huang et al.
2013/0021801 A1* 1/2013 Lee ..... F21L 15/14 362/277
2014/0049967 A1 2/2014 Zhou

OTHER PUBLICATIONS

Search Report dated Feb. 13, 2017 of the corresponding European patent application.

* cited by examiner

*Primary Examiner* — Anh Mai
*Assistant Examiner* — Steven Horikoshi
(74) *Attorney, Agent, or Firm* — Chun-Ming Shih; HDLS IPR Services

(57) ABSTRACT

A variable focus lighting fixture includes a fixed sleeve assembly, a moveable sleeve assembly, a light emitting unit, a lens and an actuation assembly. The moveable sleeve assembly penetrates into the fixed sleeve assembly and moves relative to the fixed sleeve assembly. The light emitting unit is secured onto the fixed sleeve assembly. The lens is secured onto the moveable sleeve assembly. The actuation assembly is connected between the moveable sleeve assembly and the fixed sleeve assembly. The actuation assembly includes a spiral curve slot and a sliding pin penetrating into the spiral curve slot. When the moveable sleeve assembly rotates along a central axis of the moveable sleeve assembly, the sliding pin moves along the spiral curve slot to drive the moveable sleeve assembly to move along the axial direction thereof. Accordingly, the projection path of the light from the light emitting unit through the lens is altered.

10 Claims, 10 Drawing Sheets

VARIABLE FOCUS LIGHTING FIXTURE

BACKGROUND OF THE INVENTION

Field of the Invention

The present invention is related to a lighting fixture, in particular, to a variable focus lighting fixture.

Description of Related Art

A typical variable lens lighting fixture comprises an inner sleeve and an outer sleeve using threads for fastening onto each other. The inner sleeve includes a light source arranged therein, and the outer sleeve includes a lens arranged corresponding to the light source. When the inner sleeve and the outer sleeve are rotated relative to each other, the threads can be used to allow the inner sleeve and the outer sleeve to generate movements toward each other such that the distance between the light source and the lens is changed; consequently, the light source projection path is changed. Nevertheless, the configuration of the threads cannot allow the arrangement of inclinations angles at greater degrees, and the stroke capable of being moved by each rotation is limited. Therefore, there is a need to configure a circumferential stroke of a relatively great length in order; nonetheless, the threads are prone to wear out due to such excessive long distance of friction. Moreover, a gap is required between the male and female threads in order to generate rotations such that it is likely to cause the precision of the action to be poor.

In view of the above, it is an objective of the inventor of the present invention to provide a solution capable of overcoming the aforementioned problems of low compatibility of the signal interface sockets associated with the currently existing portable electronic devices.

SUMMARY OF THE INVENTION

The present invention provides a variable focus lighting fixture, comprising a fixed sleeve assembly, a moveable sleeve assembly, a light emitting unit, a lens secured onto the moveable sleeve assembly and an actuation assembly. The moveable sleeve assembly penetrates into the fixed sleeve assembly and is capable of moving relative to the fixed sleeve assembly. The light emitting unit is secured onto the fixed sleeve assembly. The lens is secured onto the moveable sleeve assembly. The actuation assembly is connected between the moveable sleeve assembly and the fixed sleeve assembly; the actuation assembly includes a spiral curve slot and a sliding pin; the sliding pin penetrates into the spiral curve slot. When the moveable sleeve assembly rotates along a central axis of the moveable sleeve assembly, the sliding pin moves along the spiral curve slot in order to drive the moveable sleeve assembly to move along an axial direction of the moveable sleeve assembly.

For the variable focus lighting fixture of the present invention, the actuation assembly can comprise a spiral curve slot formed on the fixed sleeve assembly and a sliding pin arranged on the moveable sleeve assembly; the sliding pin penetrates into the spiral curve slot and is capable of moving along the spiral curve slot. The actuation assembly can also comprise a spiral curve slot arranged on the moveable sleeve assembly and a sliding pin arranged on the fixed sleeve assembly; the sliding pin penetrates into the spiral curve slot and is capable of moving along the spiral curve slot For the variable focus lighting fixture of the present invention, a rear end of the sliding pin includes a roller disposed thereon, and the roller abuts against an inner wall of the spiral curve slot. The sliding pin includes a spring arranged therein; two ends of the spring respectively abut against the roller and another end of the sliding pin opposite from the rear end.

For the variable focus lighting fixture of the present invention, the moveable sleeve assembly includes a pressing ring fastened thereto; the pressing ring and the moveable sleeve assembly are arranged coaxially with each other, and an edge of the lens is clamped between the pressing ring and the moveable sleeve assembly. For the variable focus lighting fixture of the present invention, the moveable sleeve assembly includes an outer protruding edge extended therefrom, and the outer protruding edge protrudes out of the fixed sleeve assembly in a longitudinal direction of the fixed sleeve assembly, and the outer protruding edge also protrudes out of the fixed sleeve assembly in a lateral direction of the fixed sleeve assembly. The lens includes a concave slot formed thereon, and the concave slot is arranged corresponding to a location of the light emitting unit.

For the variable focus lighting fixture of the present invention, it can further comprise a plurality of actuation assemblies, and the plurality of actuation assemblies are arranged in a ring and spaced apart from each other. The spiral curve slot extends spirally and an extension curve angle is within 360 degrees.

The variable focus lighting fixture of the present invention is able to allow a user to rotate the outer protruding edge of the moveable sleeve assembly in such a way that the sliding pin can be actuated in cooperation with the spiral curve slot relatively in order to allow the moveable sleeve assembly to move relative the central axis relative to the fixed sleeve assembly; therefore, the light projection path can be altered.

DETAILED DESCRIPTION OF THE INVENTION

Figure 1:
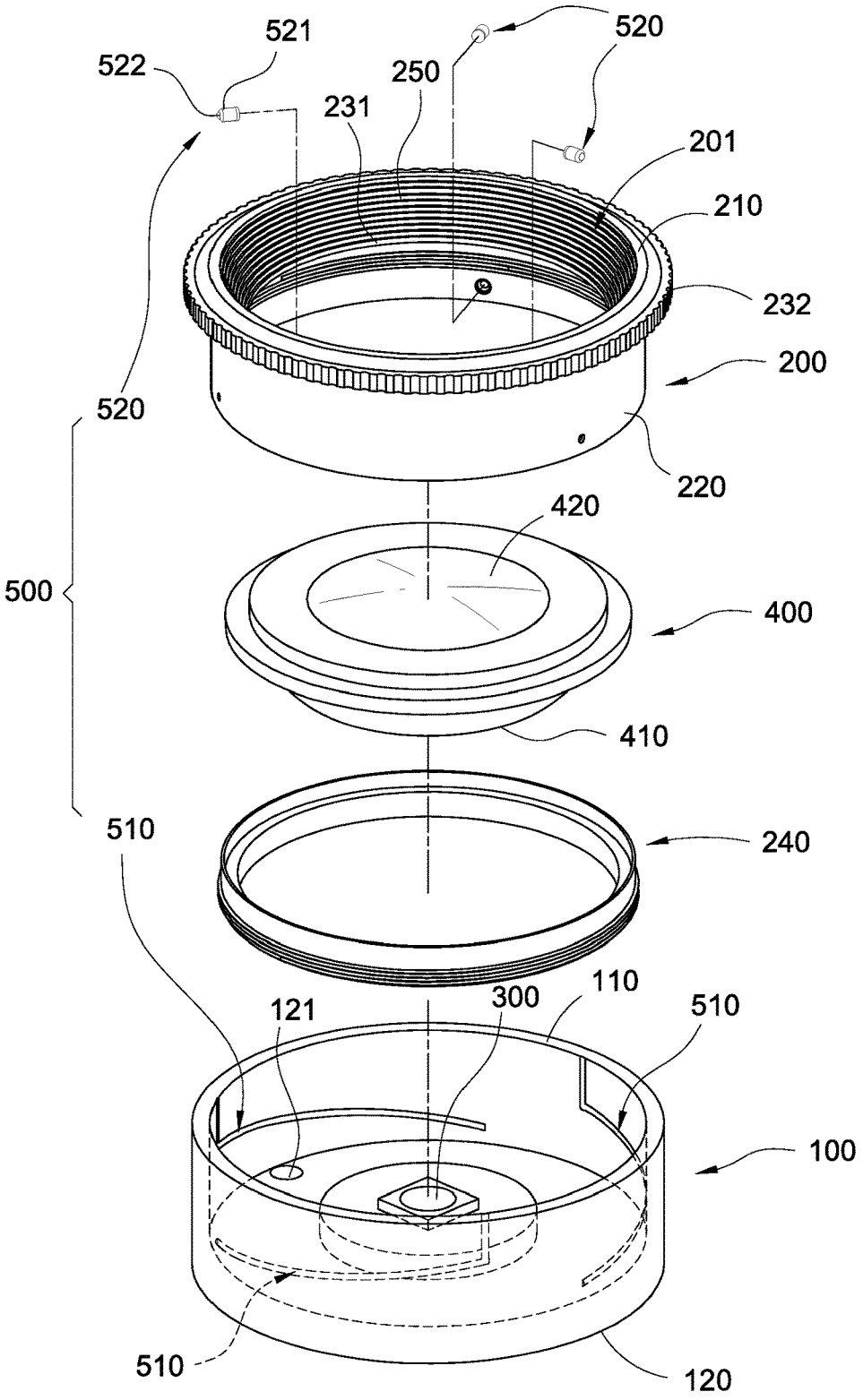
FIG. 1 is a perspective exploded view of a variable focus lighting fixture according to a first embodiment of the present invention.
Figure 2:
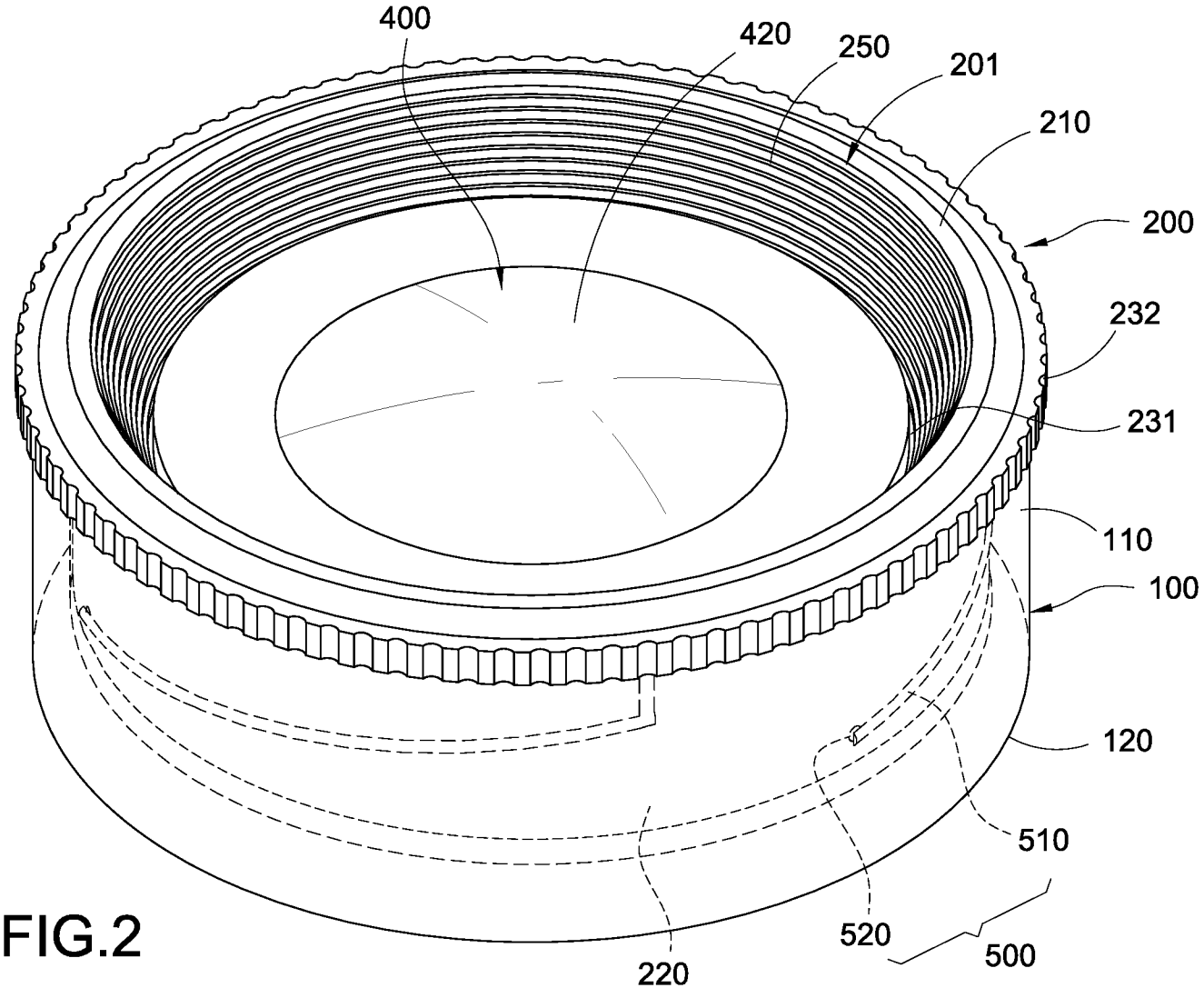
FIG. 2 is a perspective view of the variable focus lighting fixture according to the first embodiment of the present invention.

As shown in FIG. 1 to FIG. 5, according to a first embodiment of the present invention, a variable focus lighting fixture comprises a fixed sleeve assembly 100, a moveable sleeve assembly 200, a light emitting unit 300, a lens 400 and at least one actuation assembly 500.

In this embodiment, the fixed sleeve assembly 100 is preferably to be a cylinder having an opening end such that the two opposite ends thereof include an opening end 110 of an opened shape and a bottom end 120 of a closed shape. In addition, the bottom end 120 further includes at least one through hole 121 formed thereon and provided for cables to penetrate therethrough.

In this embodiment, the moveable sleeve assembly 200 is preferably to be a cylinder having two opening ends such that the two opposite ends thereof include an outer end 210 and an inner end 220. The outer end 210 of the moveable sleeve assembly 200 includes a projecting opening 201 and the internal of the outer end 210 includes an inner protruding edge 231 formed therein. An inner diameter of the outer end 210 expands from the inner protruding edge 231 toward the projecting opening 201 of the outer end 210. Furthermore, the inner side wall between the inner protruding edge 231 of the outer end 210 and the projecting opening 201 include an anti-glare structure 250 of a stepped shape formed thereon. The anti-glare structure 250 utilizes the method of reflecting light to adjust the projection path of the light in order to achieve the effect of anti-glare. The inner side wall of the inner end 220 of the moveable sleeve assembly 200 includes threads provided for a pressing ring 240 to be fastened thereon. In addition, the pressing ring 240 and the moveable sleeve assembly 200 are arranged coaxially with each other. The moveable sleeve assembly 200 coaxially penetrates into the fixed sleeve assembly 100 and is capable of moving along the central axis relative to the fixed sleeve assembly 100. The inner end 220 of the moveable sleeve assembly 200 is arranged toward the bottom end 120 of the fixed sleeve assembly 100. The outer end 210 of the moveable sleeve assembly 200 includes an outer protruding edge 232 extended outward in the radial direction. The outer protruding edge 232 protrudes out of the fixed sleeve assembly 100 in the longitudinal direction of the fixed sleeve assembly 100, and the outer protruding edge 232 also protrudes out of the fixed sleeve assembly 100 in the lateral direction of the fixed sleeve assembly 100.

In this embodiment, the light emitting unit 300 is preferably to be light emitting diode; however, the present invention is not limited to such type only. The light emitting unit 300 is secured on the inner side of the bottom end 120 of the fixed sleeve assembly 100 and is arranged toward the opening end 110.

In this embodiment, the lens 400 includes a light incident side 410 and a light exit side 420. The light incident side 410 includes a concave slot 411 formed to indent thereon. The edge of the lens 400 is clamped by the pressing ring 240 and the inner protruding edge 231 of the moveable sleeve assembly 200 in order to be secured inside the moveable sleeve assembly 200. In addition, the concave slot 411 is arranged corresponding to the location of the light emitting unit 300 and toward the lighting emitting unit 300.

In this embodiment, it is preferably to comprise three sets of actuation assemblies 500 with structures and functions completely identical to each other. Each actuation assembly 500 is respectively connected between the inner side of the fixed sleeve assembly 100 and the outer side of the moveable sleeve assembly 200. In addition, the plurality of actuation assemblies 500 are arranged in a ring and spaced apart from each other. In the subsequent content, one of the actuation assemblies 500 is used for illustrations on its structure and actuation method.

In this embodiment, each actuation assembly 500 comprises a spiral curve slot 510 formed on an inner wall surface of the fixed sleeve assembly 100 and a sliding pin 520 arranged on the moveable sleeve assembly 200 and corresponding to such spiral curve slot 510. The spiral curve slot 510 extends along a spiral line and its extension curve angle is preferably within 360 degree. In this embodiment, the sliding slot 520 is a hollow column and includes an opening rear end 521. The internal of the sliding pin 520 includes a spring 523 and a roller 522 disposed therein. The roller 522 is disposed at the rear end 521 of the sliding pin 520, and the diameter of the roller 522 is greater than the aperture of the rear end of the sliding pin 520. The two ends of the spring 523 abut against the roller 522 and another end of the sliding pin 520 opposite from the rear end 521, respectively. The rear end 521 of the sliding pin 520 protrudes at the outer side wall of the moveable sleeve assembly 200 and penetrates into the corresponding spiral curve slot 510. The roller 522 abuts against the inner wall of the spiral curve slot 510 in order to allow the sliding pin 520 to be able to move along the spiral curve slot 510.

Figure 3:
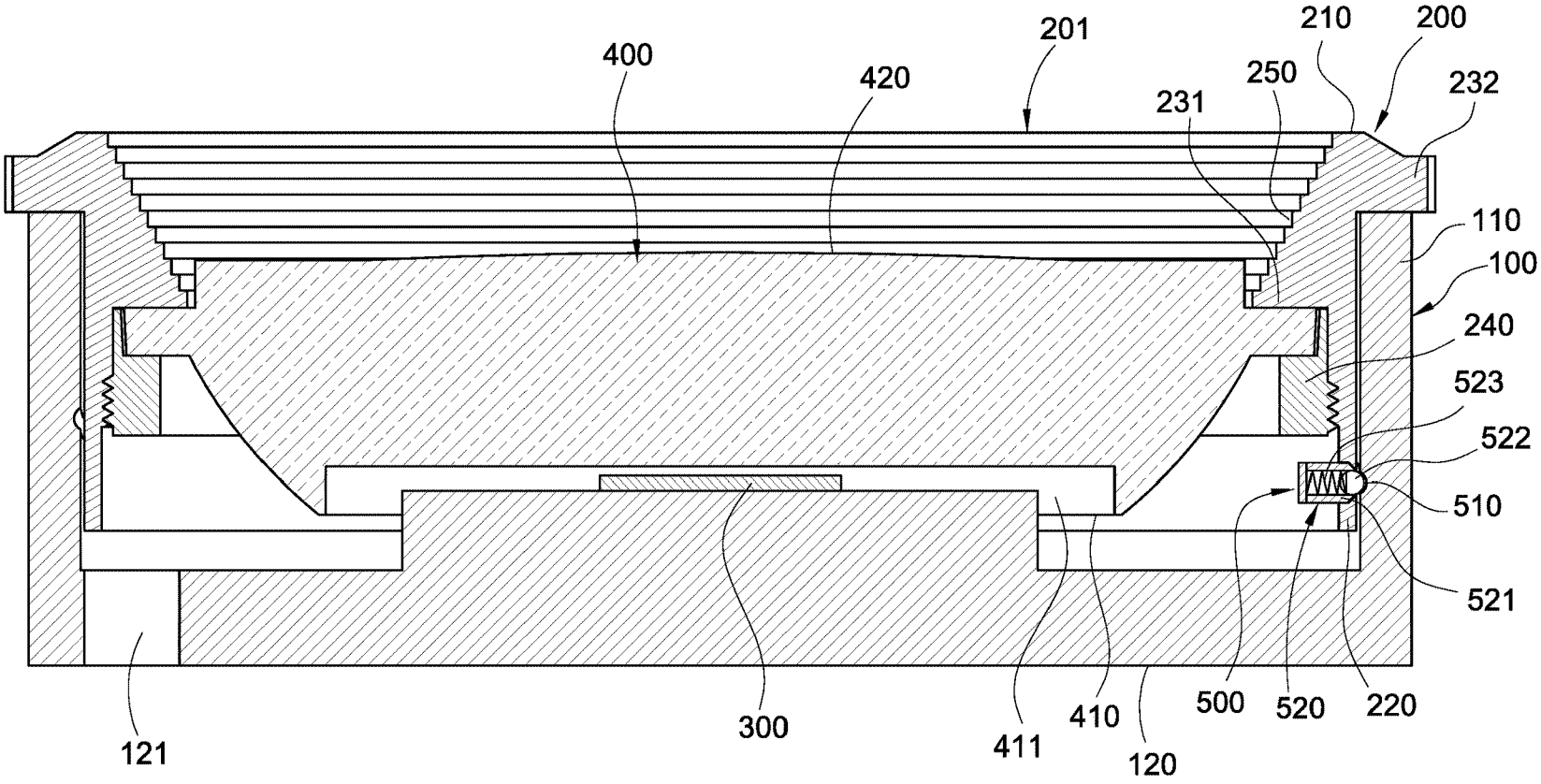
FIG. 3 is a longitudinal cross sectional view of the variable focus lighting fixture according to the first embodiment of the present invention.
Figure 4:
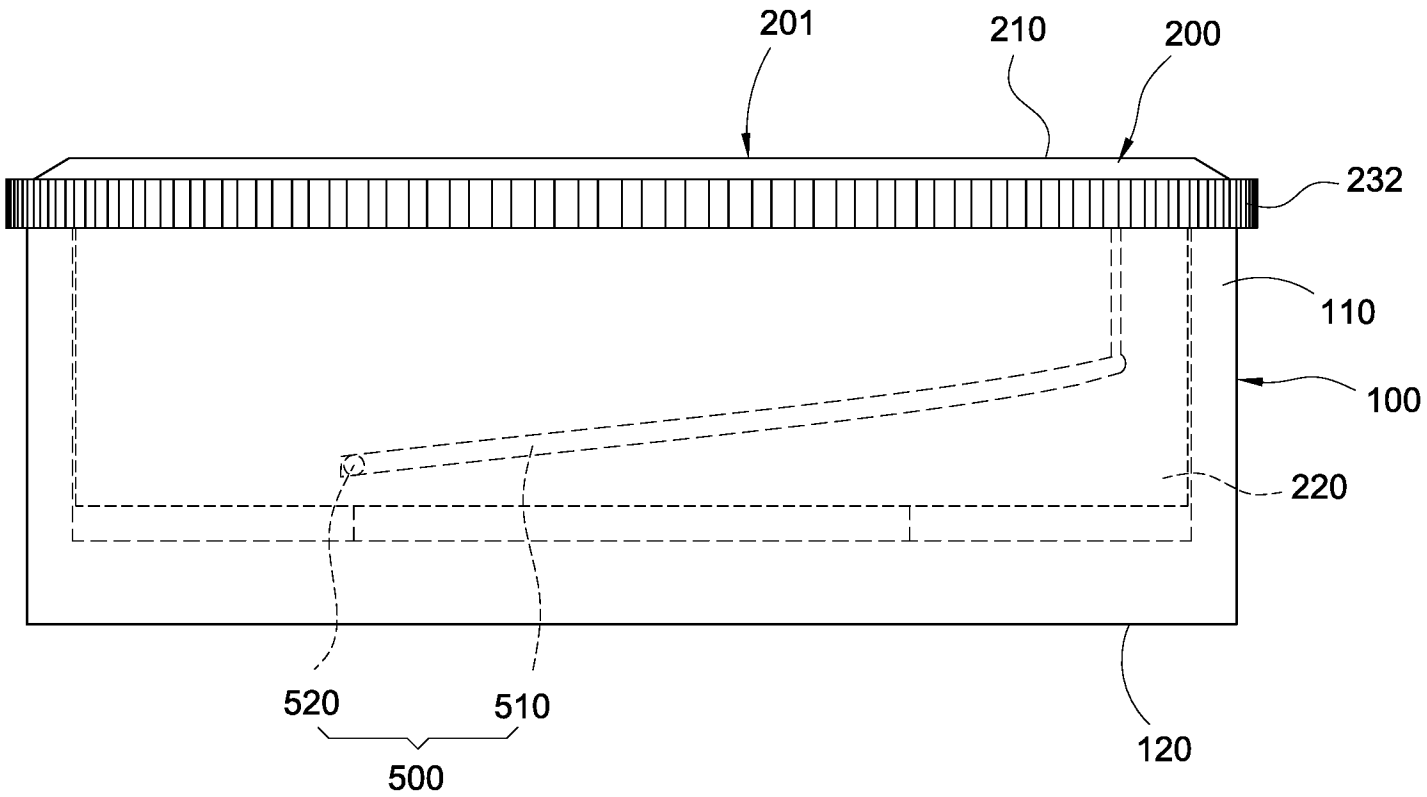
FIG. 4 is an illustration showing a state of use of the variable focus lighting fixture according to the first embodiment of the present invention.
Figure 5:
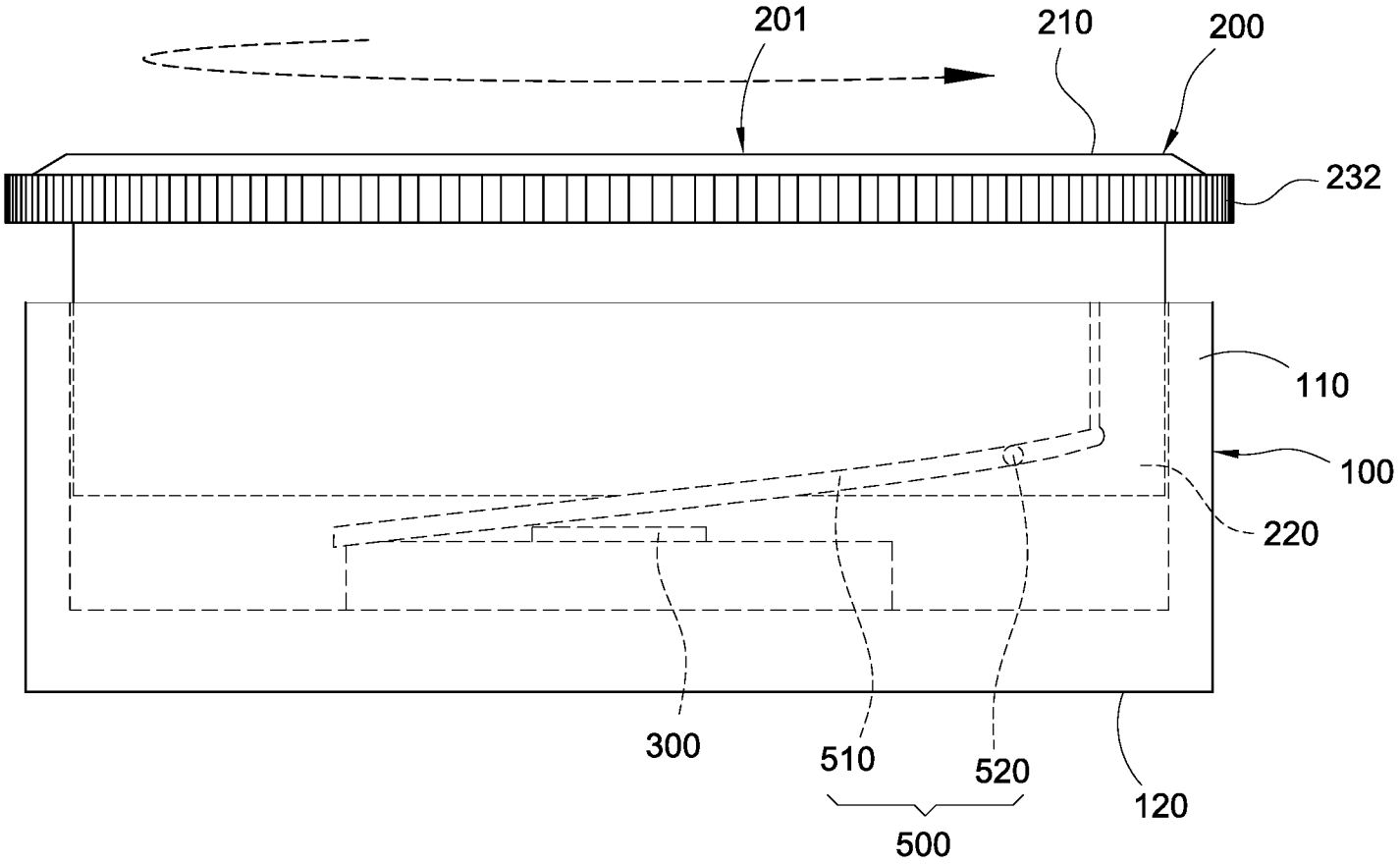
FIG. 5 is another illustration showing a state of use of the variable focus lighting fixture according to the first embodiment of the present invention.
Figure 6:
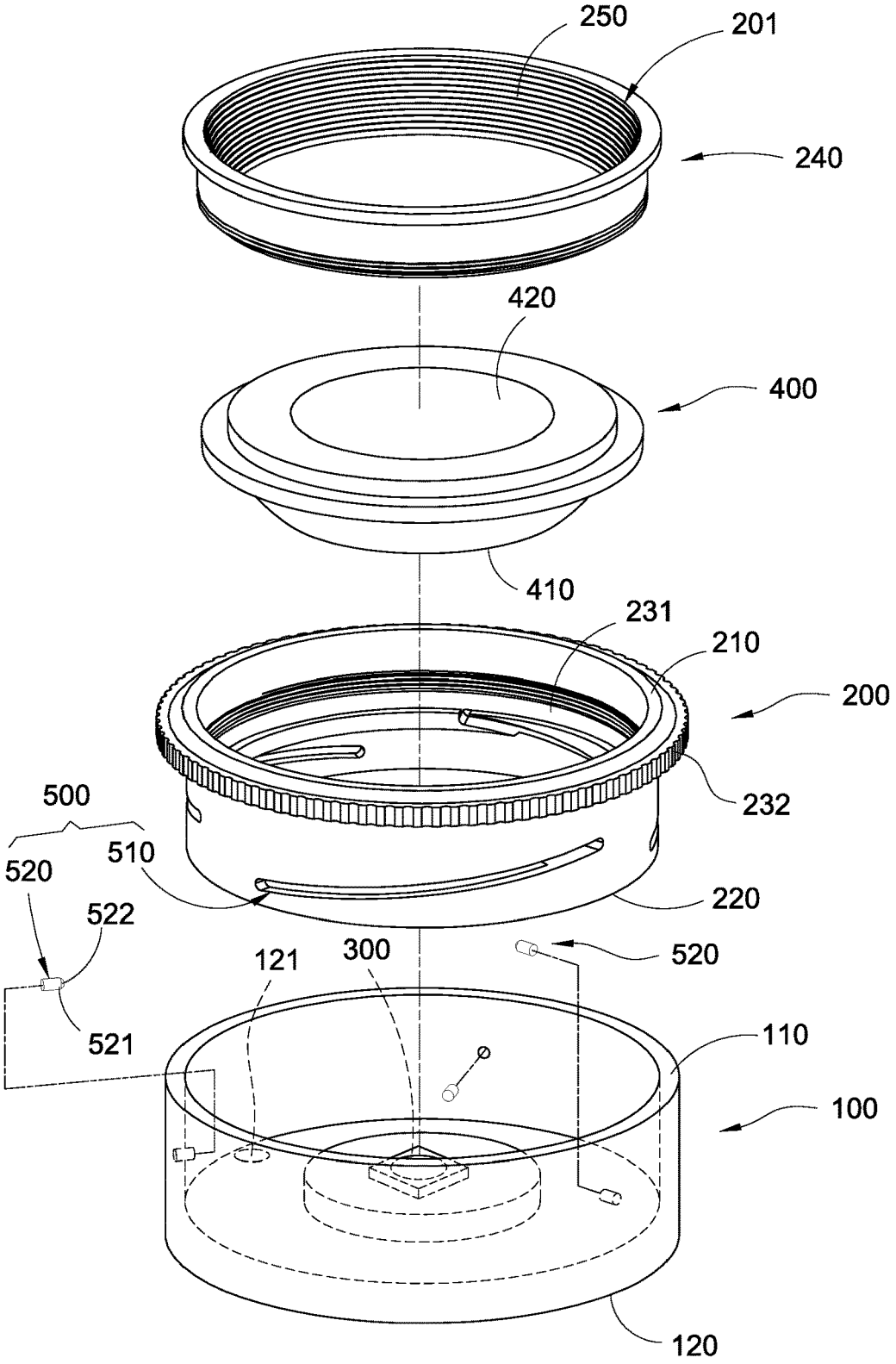
FIG. 6 is a perspective exploded view of a variable focus lighting fixture according to a second embodiment of the present invention.
Figure 7:
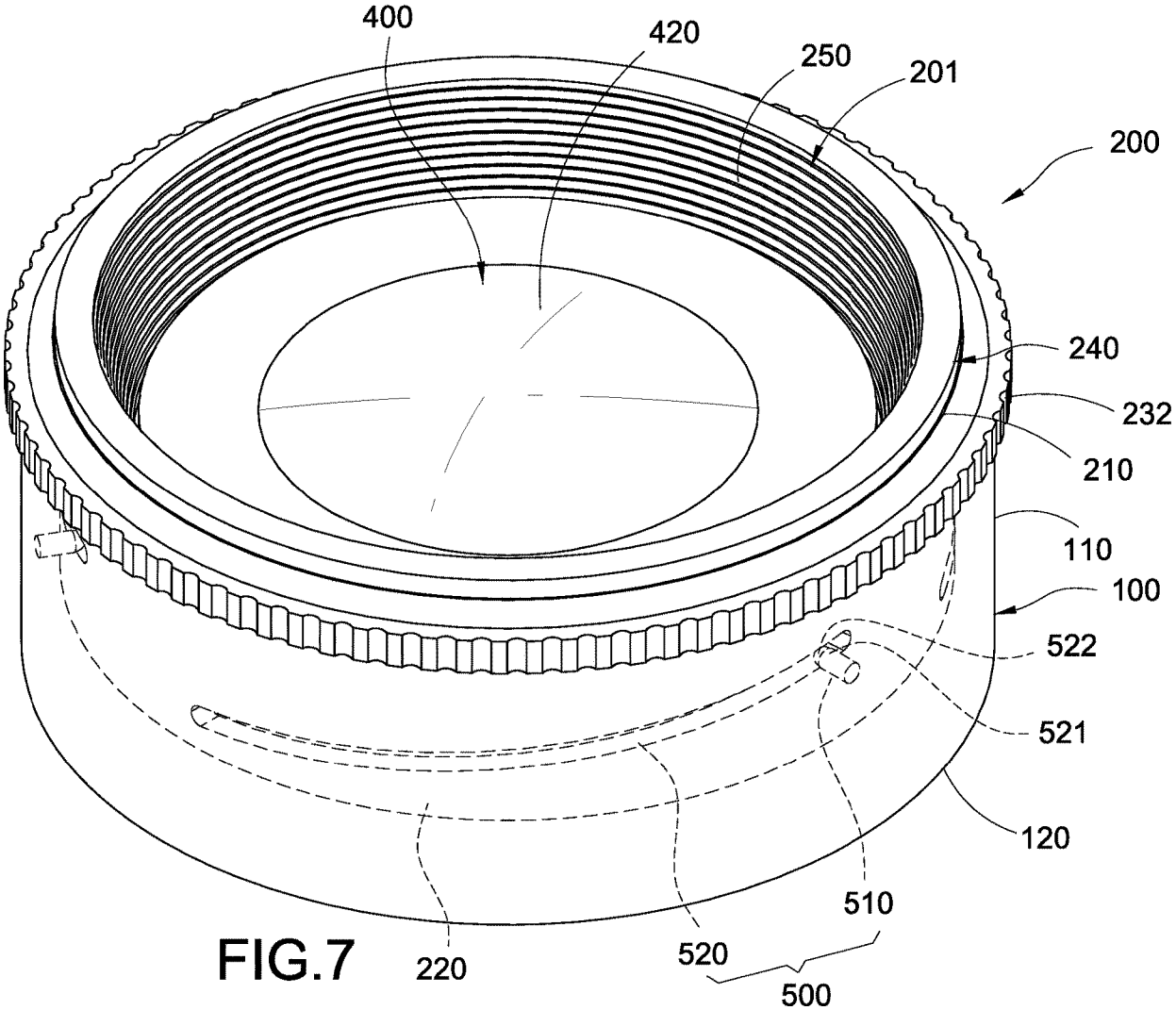
FIG. 7 is a perspective view of the variable focus lighting fixture according to the second embodiment of the present invention.

As shown in FIG. 3 to FIG. 5, the variable focus lighting fixture of the present invention is provided for the user to rotate the outer protruding edge 232 of the moveable sleeve assembly 200 in order to allow the moveable sleeve assembly 200 to move along the central axis relative to the fixed sleeve assembly 100. When the user rotates the outer protruding edge 232, the moveable sleeve assembly 200 rotates along its central axis in order to allow the sliding pin 520 of the actuation assembly 500 to move along the spiral curve slot 510, such that it is able to generate a longitudinal displacement along the fixed sleeve assembly 100 or the moveable sleeve assembly 200; consequently, it is able to drive the moveable sleeve assembly 200 to move along its axial direction. The aforementioned action is able to cause a change in the distance between the light emitting unit 300 and the lens 400 such that the path of the light generated by the light emitting unit 300 after penetrating through the lens 400 can be altered.

As shown in FIG. 6 to FIG. 10, according to a second embodiment of the present invention, a variable focus lighting fixture comprises a variable focus lighting fixture comprises a fixed sleeve assembly 100, a moveable sleeve assembly 200, a light emitting unit 300, a lens 400 and at least one actuation assembly 500.

In this embodiment, the fixed sleeve assembly 100 is preferably to be a cylinder having an opening end such that the two opposite ends thereof include an opening end 110 of an opened shape and a bottom end 120 of a closed shape. In addition, the bottom end 120 further includes at least one through hole 121 formed thereon and provided for cables to penetrate therethrough.

In this embodiment, the moveable sleeve assembly 200 is preferably to be a cylinder having two opening ends such that the two opposite ends thereof include an outer end 210 and an inner end 220. The inner side wall of the outer end 210 of the moveable sleeve assembly 200 includes threads provided for a pressing ring 240 to be fastened thereon. In addition, the pressing ring 240 and the moveable sleeve assembly 200 are arranged coaxially with each other. The inner side wall of the inner end 220 of the moveable sleeve assembly 200 includes an inner protruding edge 231 formed thereon. One side of the pressing ring 240 includes a projecting opening 201, and the projecting opening 201 is arranged inside the outer end 210 of the moveable sleeve assembly 200. The inner wall of the pressing ring 240 is of a tapered shape, and the inner diameter of the pressing ring 240 expands from the internal of the movable sleeve assembly 200 toward the projecting opening 201. The inner side wall of the pressing ring 240 includes an anti-glare structure 250 of a stepped shape formed thereon. The anti-glare structure 250 utilizes the method of reflecting light to adjust the projection path of the light in order to achieve the effect of anti-glare. The moveable sleeve assembly 200 coaxially penetrates into the fixed sleeve assembly 100 and is capable of moving along the central axis relative to the fixed sleeve assembly 100. The inner end 220 of the moveable sleeve assembly 200 is arranged toward the bottom end 120 of the fixed sleeve assembly 100. The outer end 210 of the moveable sleeve assembly 200 includes an outer protruding edge 232 extended outward in the radial direction. The outer protruding edge 232 protrudes out of the fixed sleeve assembly 100 in the longitudinal direction of the fixed sleeve assembly 100, and the outer protruding edge 232 also protrudes out of the fixed sleeve assembly 100 in the lateral direction of the fixed sleeve assembly 100.

In this embodiment, the light emitting unit 300 is preferably to be light emitting diode; however, the present invention is not limited to such type only. The light emitting unit 300 is secured on the inner side of the bottom end 120 of the fixed sleeve assembly 100 and is arranged toward the opening end 110.

In this embodiment, the lens 400 includes a light incident side 410 and a light exit side 420. The light incident side 410 includes a concave slot 411 formed to indent thereon. The edge of the lens 400 is clamped by the pressing ring 240 and the inner protruding edge 231 of the moveable sleeve assembly 200 in order to be secured inside the moveable sleeve assembly 200. In addition, the concave slot 411 is arranged corresponding to the location of the light emitting unit 300 and toward the lighting emitting unit 300.

In this embodiment, it is preferably to comprise three sets of actuation assemblies 500 with structures and functions completely identical to each other. Each actuation assembly 500 is respectively connected between the inner side of the fixed sleeve assembly 100 and the outer side of the moveable sleeve assembly 200. In addition, the plurality of actuation assemblies 500 are arranged in a ring and spaced apart from each other. In the subsequent content, one of the actuation assemblies 500 is used for illustrations on its structure and actuation method.

In this embodiment, each actuation assembly 500 comprises a spiral curve slot 510 formed on an outer wall surface of the moveable sleeve assembly 200 and a sliding pin 520 arranged on the fixed sleeve assembly 100 and corresponding to such spiral curve slot 510. The spiral curve slot 510 extends along a spiral line and its extension curve angle is preferably within 360 degree. In this embodiment, the sliding slot 520 is a hollow column and includes an opening rear end 521. The internal of the sliding pin 520 includes a spring 523 and a roller 522 disposed therein. The roller 522 is disposed at the rear end 521 of the sliding pin 520, and the diameter of the roller 522 is greater than the aperture of the rear end 521 of the sliding pin 520. The two ends of the spring 523 abut against the roller 522 and another end of the sliding pin 520 opposite from the rear end 521 respectively. The rear end 521 of the sliding pin 520 protrudes at the outer side wall of the moveable sleeve assembly 200 and penetrates into the corresponding spiral curve slot 510. The roller 522 abuts against the inner wall of the spiral curve slot 510 in order to allow the sliding pin 520 to be able to move along the spiral curve slot 510. Furthermore, the sliding pin 520 is preferable to be embedded and locked into the inner wall of the fixed sleeve assembly 100 such that the appearance of the fixed sleeve assembly 100 is not damages; consequently, it is able to prevent water vapor from infiltration therein.

Figure 8:
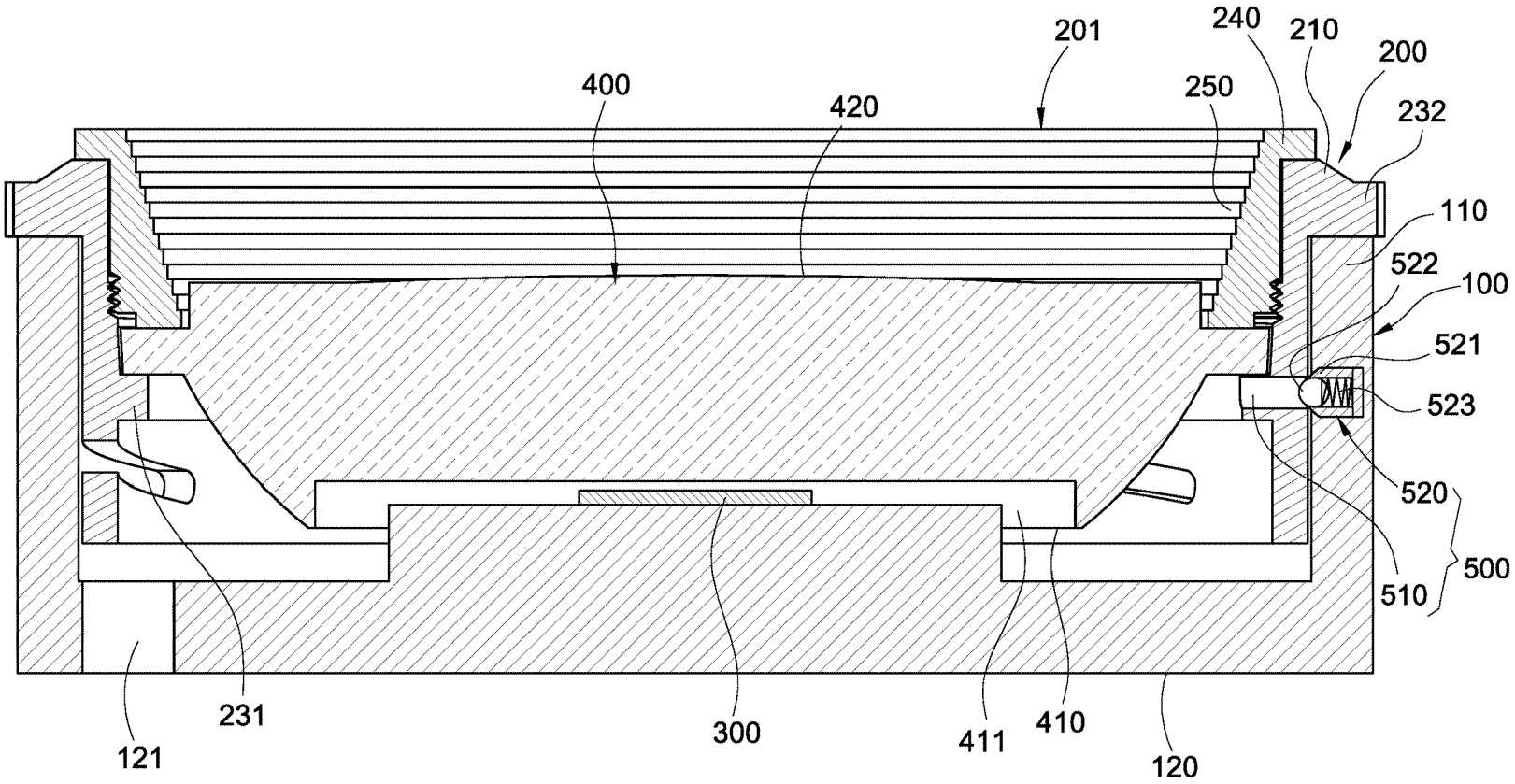
FIG. 8 is a longitudinal cross sectional view of the variable focus lighting fixture according to the second embodiment of the present invention.
Figure 9:
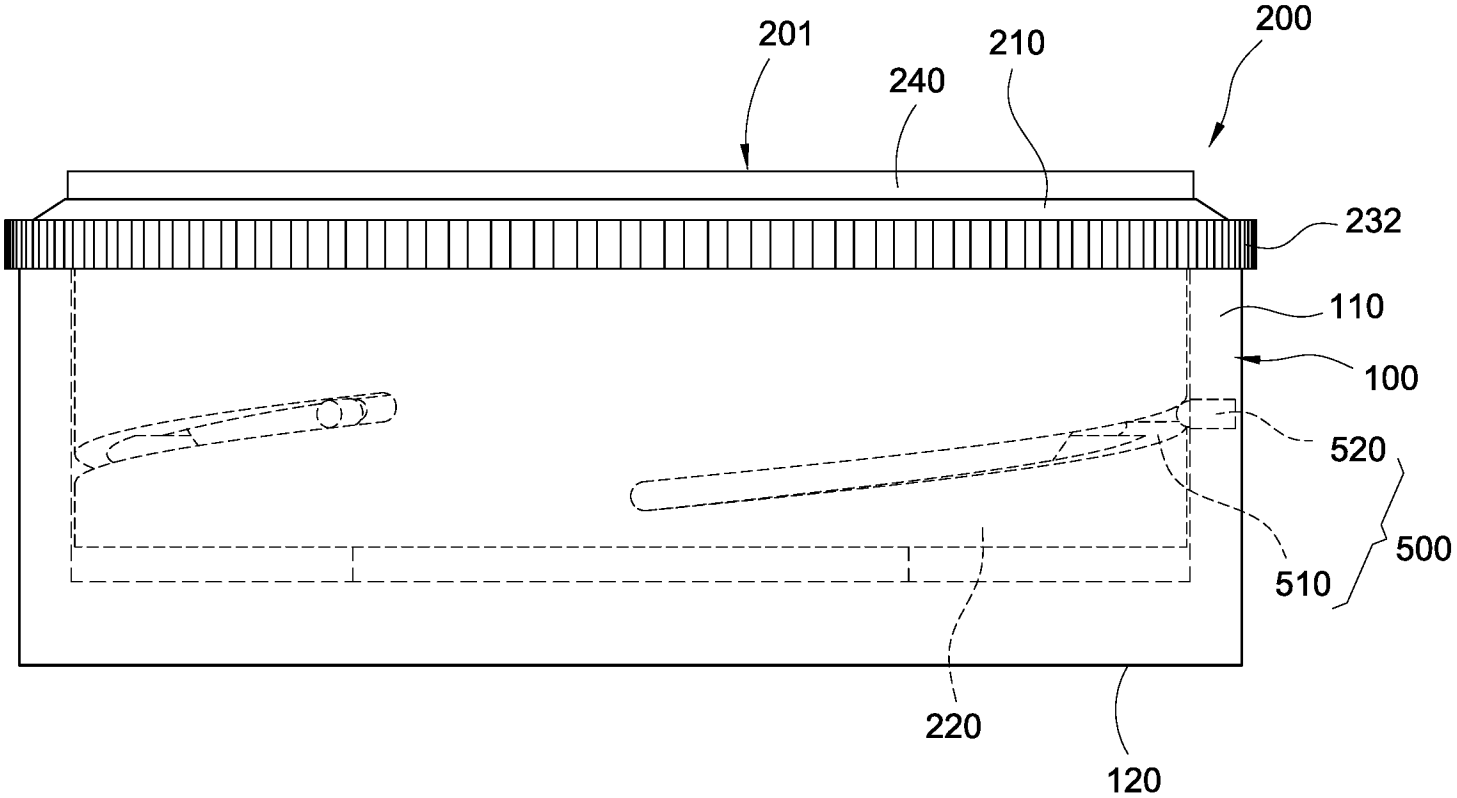
FIG. 9 is an illustration showing a state of use of the variable focus lighting fixture according to the second embodiment of the present invention.
Figure 10:
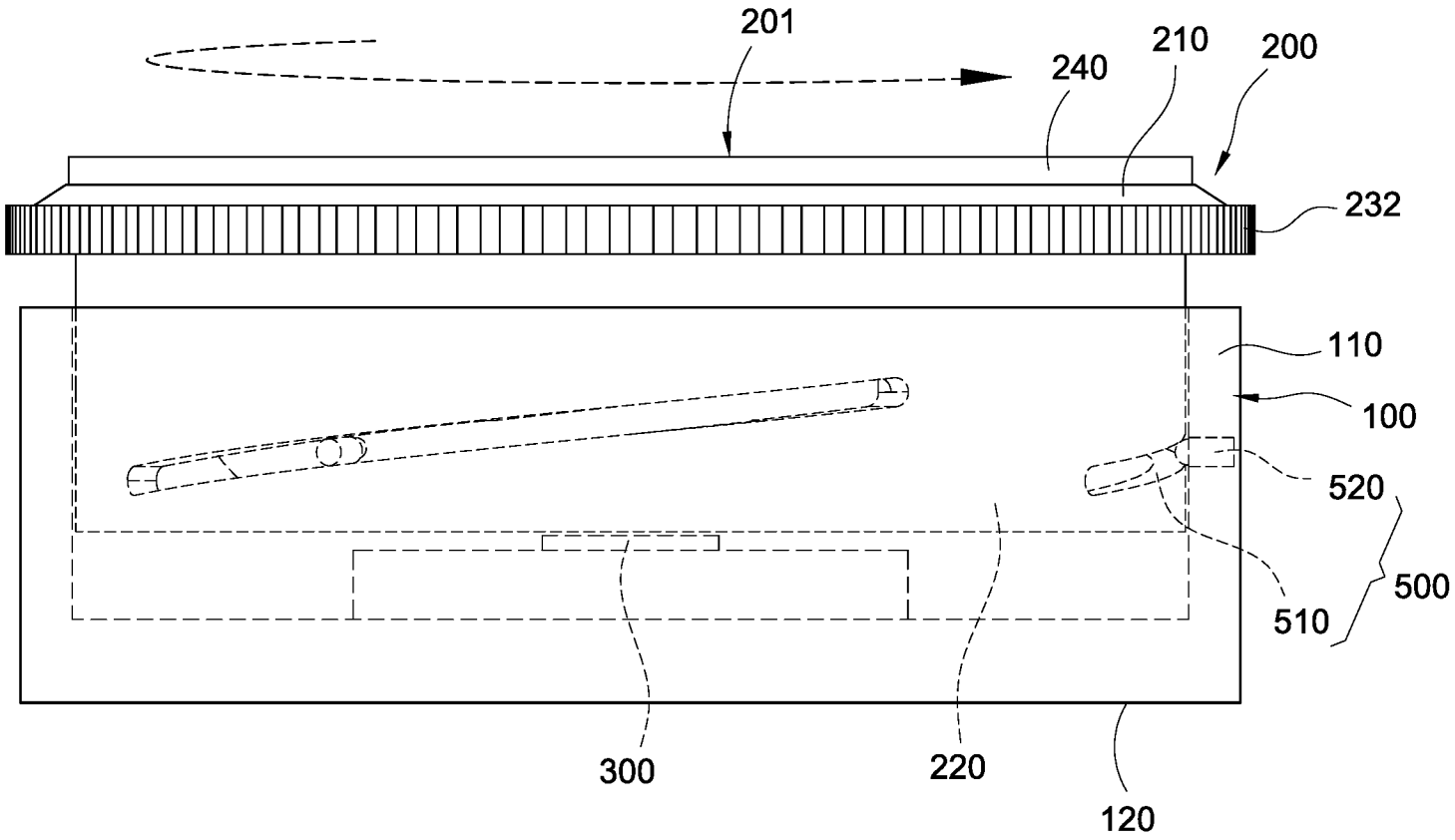
FIG. 10 is another illustration showing a state of use of the variable focus lighting fixture according to the second embodiment of the present invention.

As shown in FIG. 8 to FIG. 10, the variable focus lighting fixture of the present invention is provided for the user to rotate the outer protruding edge 232 of the moveable sleeve assembly 200 in order to allow the moveable sleeve assembly 200 to move along the central axis relative to the fixed sleeve assembly 100. When the user rotates the outer protruding edge 232, the moveable sleeve assembly 200 rotates along its central axis in order to allow the sliding pin 520 of the actuation assembly 500 to move along the spiral curve slot 510 such that it is able to generate a longitudinal displacement along the fixed sleeve assembly 100 or the moveable sleeve assembly 200; consequently, it is able to drive the moveable sleeve assembly 200 to move along its axial direction. The aforementioned action is able to cause a change in the distance between the light emitting unit 300 and the lens 400 such that the path of the light generated by the light emitting unit 300 after penetrating through the lens 400 can be altered.

The variable focus lighting fixture of the present invention is provided to allow the user to rotate the outer protruding edge 232 of the moveable sleeve assembly 200 such that the sliding pin 520 is able to actuate in cooperation with the spiral curve slot 510 relatively in order to allow the moveable sleeve assembly 200 to move along the central axis relative to the fixed sleeve assembly 100; consequently, the light projection path can be altered. Since the spiral curve slot 510 can be configured to have a greater inclination angle in comparison to the threads, the stroke of the spiral curve slot 510 is reduced such that the rate of the wear out between the sliding pin 520 and the spiral curve slot 510 can be reduced. The roller 522 abuts the spiral curve slot 510 such that frictional force between the sliding pin 520 and the spiral curve slot 510 can be reduced while the gap therebetween is eliminated in order to increase the precision of the actuation. As a result, the variable focus light fixture of the present invention is of a longer useful lifetime and a greater precision. Moreover, the variable focus lighting fixture of the present invention is able to allow its moveable sleeve assembly 200 to be rotated and moved simultaneously; therefore, during the adjustment of the light projection path, only one single assembly is required to be moved, which is advantageous in such a way that the fewer the number of moveable assemblies, the high the precision of the actuation. The concave slot 411 formed on the lens 400 allows the light emitting unit 300 to move therein such that the moveable sleeve assembly 200 is able to have a longer axial stroke.

In view of the above, the embodiments disclosed above is for illustrative purpose only to describe the present invention, which shall not be used to limit the scope of the present invention. The scope of the present invention shall be determined based on the claims enclosed hereafter, which covers all legitimate equivalent embodiments and shall not be limited to the aforementioned embodiments only.

What is claimed is:

1. A variable focus lighting fixture, comprising:

a fixed sleeve assembly;

a moveable sleeve assembly penetrating into the fixed sleeve assembly and capable of moving relative to the fixed sleeve assembly;

a light emitting unit secured onto the fixed sleeve assembly;

a lens secured onto the moveable sleeve assembly; and an actuation assembly connected between the moveable sleeve assembly and the fixed sleeve assembly; the actuation assembly having a spiral curve slot and a sliding pin; the sliding pin penetrating into the spiral curve slot;

wherein when the moveable sleeve assembly rotates along a central axis of the moveable sleeve assembly, the sliding pin moves along the spiral curve slot in order to drive the moveable sleeve assembly to move along an axial direction of the moveable sleeve assembly;

wherein a rear end of the sliding pin includes a roller disposed thereon, and the roller abuts against an inner wall of the spiral curve slot.

2. The variable focus lighting fixture according to claim 1, wherein the spiral curve slot is arranged on the fixed sleeve assembly, and the sliding pin is arranged on the moveable sleeve assembly.

3. The variable focus lighting fixture according to claim 1, wherein the spiral curve slot is arranged on the moveable sleeve assembly, and the sliding pin is arranged on the fixed sleeve assembly.

4. The variable focus lighting fixture according to claim 1, wherein the sliding pin includes a spring arranged therein; two ends of the spring respectively abut against the roller and another end of the sliding pin opposite from the rear end.

5. The variable focus lighting fixture according to claim 1, wherein the moveable sleeve assembly includes an outer protruding edge extended therefrom, and the outer protruding edge protrudes out of the fixed sleeve assembly in a longitudinal direction of the fixed sleeve assembly.

6. The variable focus lighting fixture according to claim 5, wherein the outer protruding edge protrudes out of the fixed sleeve assembly in a lateral direction of the fixed sleeve assembly.

7. The variable focus lighting fixture according to claim 1, wherein the moveable sleeve assembly includes a pressing ring fastened thereto; the pressing ring and the moveable sleeve assembly are arranged coaxially with each other, and an edge of the lens is clamped between the pressing ring and the moveable sleeve assembly.

8. The variable focus lighting fixture according to claim 1, wherein the lens includes a concave slot formed thereon, and the concave slot is arranged corresponding to a location of the light emitting unit.

9. The variable focus lighting fixture according to claim 1, further comprising a plurality of actuation assemblies, and the plurality of actuation assemblies are arranged in a ring and spaced apart from each other.

10. The variable focus lighting fixture according to claim 1, wherein the spiral curve slot extends spirally and an extension curve angle is within 360 degrees.

* * * * *